US010726796B2

(12) United States Patent
Tian

(10) Patent No.: US 10,726,796 B2
(45) Date of Patent: Jul. 28, 2020

(54) BACKLIGHT DRIVE CIRCUIT, DRIVING METHOD THEREOF, AND DISPLAY DEVICE

(71) Applicant: Wuhan China Star Optoelectronics Technology Co., Ltd., Wuhan, Hubei (CN)

(72) Inventor: Weijun Tian, Guangdong (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 0 days.

(21) Appl. No.: 16/215,635

(22) Filed: Dec. 10, 2018

(65) Prior Publication Data

US 2019/0371254 A1 Dec. 5, 2019

Related U.S. Application Data

(63) Continuation of application No. PCT/CN2018/101637, filed on Aug. 22, 2018.

(30) Foreign Application Priority Data

May 30, 2018 (CN) ..... 2018 1 0538863

(51) Int. Cl.
*G09G 3/34* (2006.01)

(52) U.S. Cl.
CPC ..... *G09G 3/3426* (2013.01)

(58) Field of Classification Search
CPC ..... G09G 3/3426
See application file for complete search history.

(56) References Cited

U.S. PATENT DOCUMENTS 7,138,995 B2 * 11/2006 Wang ..... G09G 3/32 345/212
8,791,932 B2 * 7/2014 Ueno ..... G09G 3/3426 345/102
2005/0110722 A1 * 5/2005 Hayafuji ..... G09G 3/3216 345/76
2005/0116655 A1 * 6/2005 Yazawa ..... G09G 3/3216 315/169.3

(Continued)

FOREIGN PATENT DOCUMENTS

CN 1428757 A 7/2003
CN 101083056 A 12/2007

(Continued)

OTHER PUBLICATIONS

2nd Office Action of counterpart Chinese Patent Application No. 201810538863.2 dated May 12, 2020.

*Primary Examiner* — Dmitriy Bolotin

(57) ABSTRACT

A backlight drive circuit comprises a plurality of light-emitting units arrayed in a matrix manner and at least first transistors and second transistors, wherein the light-emitting units in each row are connected to a scan line, the light-emitting units in each column are connected to a data line, at least part of the scan lines and/or the data lines are connected to first terminals of the first transistors, at least part of the scan lines and/or the data lines are connected to first terminals of the second transistors, second terminals of the first transistors and the second transistors are respectively connected to drive chip pins, control terminals of the first transistors and the second transistors are connected to a first control line.

12 Claims, 7 Drawing Sheets

(56) References Cited

U.S. PATENT DOCUMENTS

2005/0184952 A1* 8/2005 Konno ..... G09G 3/3426 345/102
2007/0046611 A1* 3/2007 Routley ..... G09G 3/3216 345/98
2009/0096741 A1* 4/2009 Kim ..... G09G 3/342 345/102
2010/0013864 A1* 1/2010 Oelhafen ..... G09G 3/3688 345/690
2010/0220047 A1* 9/2010 Adachi ..... G02F 1/133603 345/102
2011/0133673 A1 6/2011 Ryu et al.
2012/0086740 A1* 4/2012 Murai ..... G09G 3/3406 345/690
2014/0176352 A1* 6/2014 Hussain ..... G06F 3/0202 341/26
2016/0293118 A1* 10/2016 Park ..... H01L 27/124
2018/0018924 A1* 1/2018 Mao ..... G09G 3/3406
2018/0059838 A1 3/2018 Chung et al.
2018/0330654 A1* 11/2018 Moon ..... G09G 3/2003
2019/0025966 A1* 1/2019 Xing ..... G09G 3/20
2019/0066600 A1* 2/2019 Wang ..... G09G 3/3275

FOREIGN PATENT DOCUMENTS

CN 101697270 A 4/2010
CN 102591084 A 7/2012
CN 102621758 A 8/2012
CN 102866551 A 1/2013
CN 106648204 A 5/2017
CN 107479742 A 12/2017
CN 107633818 A 1/2018
KR 20180013418 A 2/2018

* cited by examiner

BACKLIGHT DRIVE CIRCUIT, DRIVING METHOD THEREOF, AND DISPLAY DEVICE

CROSS-REFERENCE TO RELATED APPLICATIONS

The present application is a continuation-application of International (PCT) Patent Application No. PCT/CN2018/101637, field on Aug. 22, 2018, which claims foreign priority of Chinese Patent Application No. 201810538863.2, field on May 30, 2018 in the State Intellectual Property Office of China, the entire contents of which are hereby incorporated by reference.

TECHNICAL FIELD

The present disclosure relates to the field of display technologies, and more particularly, to a backlight drive circuit, driving method thereof, and display device.

BACKGROUND

With the recent advantages in improved display uniformity, regional display, improvement on the contrast, narrow frames and the like, direct-type backlight has been gradually applied to mobile phone modules. The number of drive chip pins of a traditional area light is the sum of the row number and the column number of a light-emitting unit matrix in the area light; however, in order to obtain a better display effect, the row number and column number of the area light are being increased all the time, which results in more and more drive chip pins, and consequentially, the reliability of products is reduced.

SUMMARY

The technical issue mainly to be settled by the present disclosure is to provide a backlight drive circuit, a driving method thereof, and a display device. The backlight drive circuit can reduce the number of drive chip pins of an area light, thereby improving the reliability of products.

To solve the above technical problem, the present disclosure adopts a technical solution as below. There is provided a backlight drive circuit includes a plurality of light-emitting units arrayed in a matrix manner and at least first transistors and second transistors, wherein the light-emitting units in each row are connected to a scan line, the light-emitting units in each column are connected to a data line, at least part of the scan lines and/or the data lines are connected to first terminals of the first transistors, at least part of the scan lines and/or the data lines are connected to first terminals of the second transistors, second terminals of the first transistors and the second transistors are respectively connected to drive chip pins, control terminals of the first transistors and the second transistors are connected to a first control line.

To solve the above technical problem, the present disclosure adopts another technical solution as below. There is provided a display device, the display device includes a backlight drive circuit, the backlight drive circuit includes a plurality of light-emitting units arrayed in a matrix manner and at least first transistors and second transistors, wherein the light-emitting units in each row are connected to a scan line, the light-emitting units in each column are connected to a data line, at least part of the scan lines and/or the data lines are connected to first terminals of the first transistors, at least part of the scan lines and/or the data lines are connected to first terminals of the second transistors, second terminals of the first transistors and the second transistors are respectively connected to drive chip pins, control terminals of the first transistors and the second transistors are connected to a first control line.

To solve the above technical problem, the present disclosure adopts still another technical solution as below. There is provided a driving method of a backlight drive circuit, the backlight drive circuit comprises a plurality of light-emitting units arrayed in a matrix manner and at least first transistors and second transistors, the light-emitting units in each row are connected to a scan line, the light-emitting units in each column are connected to a data line, at least part of the scan lines and/or the data lines are connected to first terminals of the first transistors, at least part of the scan lines and/or the data lines are connected to first terminals of the second transistors, second terminals of the first transistors and the second transistors are respectively connected to drive chip pins, and control terminals of the first transistors and the second transistors are connected to a first control line; the driving method comprises:

inputting a scanning signal to the light-emitting units in a first row via the first transistor and inputting a data signal to the data lines so as to turn on the light-emitting units in the first row;

repeating the step to sequentially turn on the light emitting units in other rows.

The present disclosure has the following beneficial effects: different from the prior art, the backlight drive circuit of the present disclosure comprises a plurality of light-emitting units arrayed in a matrix manner and at least first transistors and second transistors, control terminals of each first transistor and the corresponding second transistor are connected to the same control line, at least part of scan lines and/or data lines are connected to first terminals of the first transistors, and at least part of the scan lines and/or data lines are connected to first terminals of the second transistors, so that the number of drive chip pins connected to second terminals of the first transistors and the second transistors is reduced, and accordingly, the reliability of products is improved.

DETAILED DESCRIPTION

A clear and complete description of the technical schemes in the embodiments of the present disclosure will be made below with reference to the accompanying drawings in the embodiments of the present disclosure. Apparently, the embodiments as recited herein are merely a part of embodiments of the present disclosure instead of all embodiments. All other embodiments obtained by a person of ordinary skill in the art based on the embodiments of the present disclosure without creative efforts shall fall within the protection scope of the present disclosure.

Figure 1:
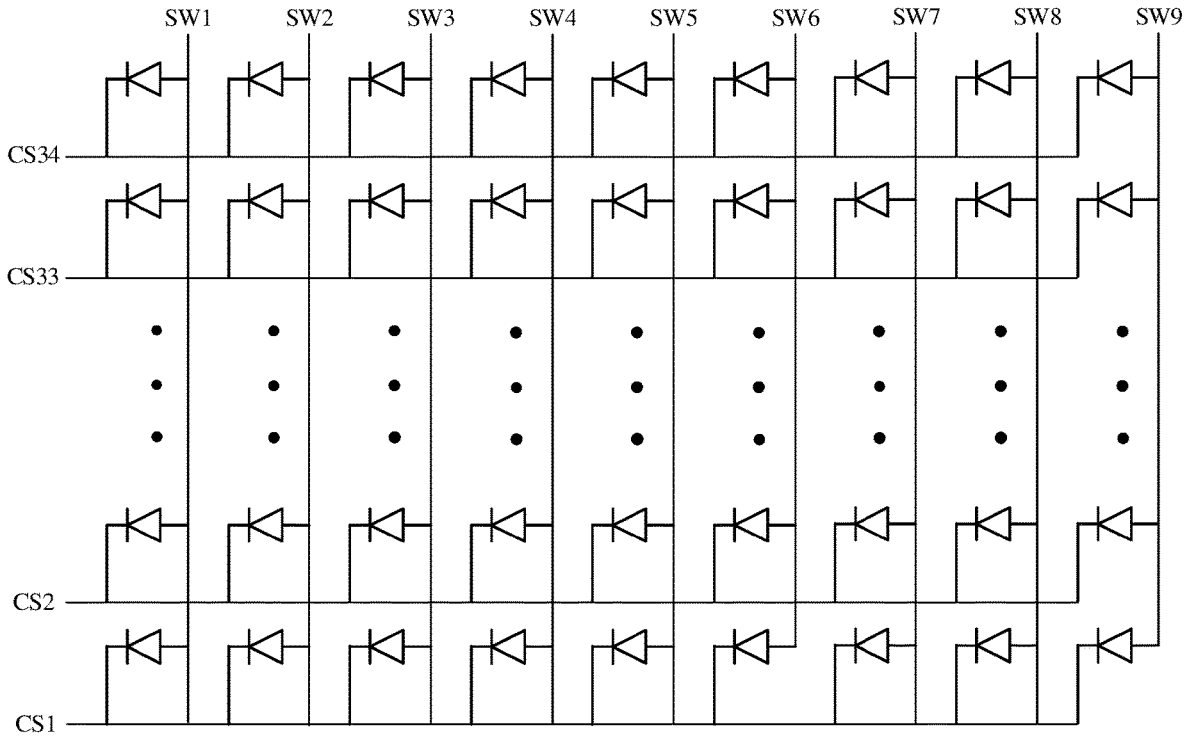
FIG. 1 is a principle diagram of a backlight drive circuit in the prior art.

Please refer to FIG. 1 which is a principle diagram of a backlight drive circuit in the prior art. As shown in FIG. 1, an area light of the direct-type backlight drive circuit comprises 34*9 zones, which means that the area light comprises 34*9 light-emitting units. The grayscale of the direct-type backlight can be locally regulated and controlled, which means that instead of being turned on at the same time, the whole area backlight is partitioned into a plurality of zones, and the brightness of each zone can be independently controlled to be matched with a liquid crystal display to display an image. Particularly, when the grayscale of the displayed image in a certain area of the liquid crystal display is low, the brightness of the corresponding zone of the direct-type backlight is decreased accordingly; and when the grayscale of the displayed image in a certain area of the liquid crystal display is high, the brightness of the corresponding zone of the direct-type backlight is increased accordingly. The brightness of the zones of the direct-type backlight dynamically changes along with grayscale changes of the image displayed by the liquid crystal display, and thus, the liquid crystal display can achieve a more excellent display effect.

A row-column scanning driving method of the backlight drive circuit in FIG. 1 comprises the following blocks: current data are input from SW1, and current data are input from CS1-CS34 at the same time, so that the 34 light-emitting units in the first column are turned on; SW1 is turned off, current data are input from SW2, current data are input from CS1-CS34 at the same time, so that the 34 light-emitting units in the second column are turned on; and the light-emitting units in other columns are turned on in the same way till the light-emitting units in the whole area are turned on. After the light-emitting units in the last column are turned on, SW1 in the first column is turned on again to repeat scanning, human eyes cannot be aware of the flickering process of the light-emitting units under the condition where the scanning speed is cover 60 HZ, and thus, it seems that the light-emitting units in the whole area are turned on. SW1-SW9 are respectively connected to nine drive chip pins and are electrically connected to the positive pole of a driving electrode through the drive chip pins, CS1-CS34 are respectively connected to 34 drive chip pins and are electrically connected to the negative pole of the driving electrode through the drive chip pins. Thus, 34+9=43 drive chip pins are needed for the backlight drive circuit in FIG. 1.

As for a backlight drive circuit including m rows and n columns, m+n drive chip pins are needed in the prior art. With the increasingly higher and higher requirement for the display effect, backlight drive circuits are partitioned into more and more zones, which increases the number of drive chip pins, and consequentially, the reliability of products is reduced. As for the backlight drive circuit in the present disclosure, the number of drive chip pins is reduced by adding transistors.

Figure 2:
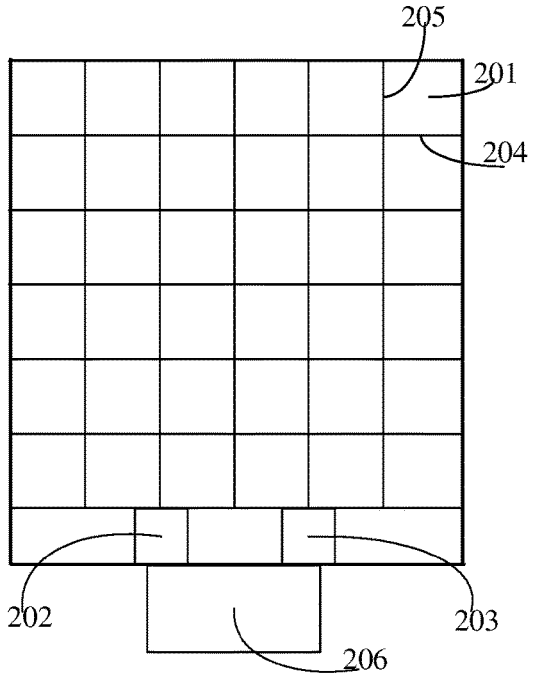
FIG. 2 is a structural view of a first embodiment of a backlight drive circuit of the present disclosure.

Please refer to FIG. 2 which is a structural view of a first embodiment of a backlight drive circuit of the present disclosure. As shown in FIG. 2, the backlight drive circuit comprises a plurality of light-emitting units 201 arrayed in a matrix manner and at least first transistors 202 and second transistors 203. The light-emitting units 201 in each row are connected to a scan line 204. The light-emitting units 201 in each column are connected to a data line 205. At least part of the scan lines 204 and/or data lines 205 are connected to first terminals of the first transistors 202, and at least part of the scan lines 204 and/or data lines 205 are connected to first terminals of the second transistors 203. Second terminals of the first transistors 202 and second terminals of the second transistors 203 are respectively connected to pins of a drive chip 206. Control terminals of each first transistor 202 and the corresponding second transistor 203 are connected to a first control line. According to the backlight drive circuit of the present disclosure, at least the first transistors and the second transistors are arranged to reduce the number of the pins of the drive chip. A detailed description is given below with reference to FIGS. 3 to 10.

Figure 3:
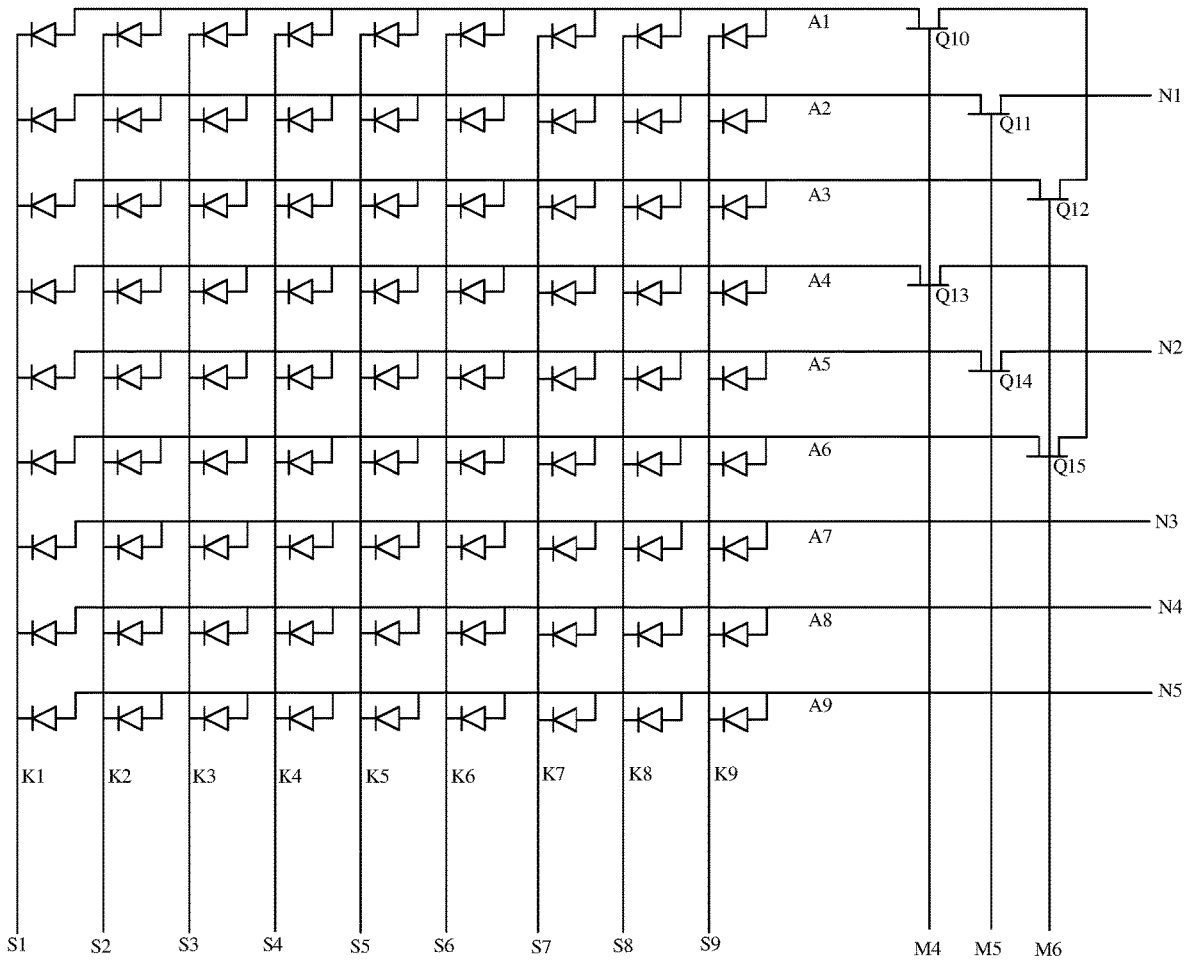
FIG. 3 is a principle diagram of a first embodiment of the backlight drive circuit of the present disclosure.

Please refer to FIG. 3 which is a principle diagram of the first embodiment of the backlight drive circuit of the present disclosure. As shown in FIG. 3, the backlight drive circuit adopts an arrangement mode of a 9*9 matrix and comprises nine scan lines A1-A9 and nine data lines K1-K9. N1-N5 are five drive chip pins, and S1-S9 are another nine drive chip pins. The light-emitting units in each row are connected to one scan line. The light-emitting units in each column are connected to one data line. The scan lines A1, A2, and A3 are respectively connected to first terminals of first transistors Q10, Q11, and Q12. The scan lines A4, A5, and A6 are respectively connected to first terminals of second transistors Q13, Q14, and Q15. The scan lines A7, A8, and A9 are respectively and directly connected to the drive chip pins N3, N4, and N5 instead of being connected to transistors. M4, M5 and M6 are three different first control lines.

Second terminals of the first transistor Q10 and the second transistor Q13 are respectively connected to the drive chip pins N1 and N2. Control terminals of the first transistor Q10 and the second transistor Q13 are both connected to the first control line M4. Second terminals of the first transistor Q11 and the second transistor Q14 are respectively connected to the drive chip pins N1 and N2. Control terminals of the first transistor Q11 and the second transistor Q14 are both connected to the first control line M5. Second terminals of the first transistor Q12 and the second transistor Q15 are respectively connected to the drive chip pins N1 and N2. Control terminals of the first transistor Q12 and the second transistor Q15 are both connected to the control line M6. The second terminals of the two different adjacent first transistors Q10 and Q11 are connected to the drive chip pin N1, and the control terminals of the two different adjacent first transistors Q10 and Q11 are respectively connected to the different adjacent control lines M4 and M5. The second terminals of the two different adjacent first transistors Q11 and Q12 are connected to the drive chip pin N1, and the control terminals of the two different adjacent first transistors Q11 and Q12 are connected to the different adjacent control lines M5 and M6. The second terminals of the two different adjacent second transistors Q13 and Q14 are connected to the drive chip pin N2, and the control terminals of the two different adjacent second transistors Q13 and Q14 are connected to the different adjacent first control lines M4 and M5. The second terminals of the two different adjacent second transistors Q14 and Q15 are connected to the drive chip pin N2, and the control terminals of the two different adjacent second transistors Q14 and Q15 are connected to the different adjacent first control lines M5 and M6.

The nine data lines K1-K9 are respectively and directly connected to the drive chip pins S1-S9, and the first control lines M4, M5, and M6 are respectively connected to three drive chip pins. In FIG. 2, totally 17 drive chip pins are used by the backlight drive circuit, but 18 drive chip pins are needed in the prior art, which means that compared with the prior art, the backlight drive circuit of the present disclosure omits one drive chip pin.

The operating process of the backlight drive circuit in FIG. 3 is as follows: a first control signal is input from the first control line M4, a scanning signal is input via the drive chip pin N1 and is transmitted to the light-emitting units in the first row, and a data signal is input to the data lines K1-K9 respectively via the drive chip pins S1-S9, so that the light-emitting units in the first row are turned on. The above step is repeated to sequentially turn on the light-emitting units in the second row, the light-emitting units in the third row, the light-emitting units in the fourth row, the light-emitting units in the fifth row, and the light-emitting units in the sixth row. Afterwards, the scanning signal is transmitted to the light-emitting units in the seventh row via the drive chip pin N3, and at the same time, the data signal is transmitted to the data lines K1-K9 respectively via the drive chip pins S1-S9 to turn on the light-emitting units in the seventh row. The step of turning on the light-emitting units in the seventh row is repeated to sequentially turn on the light-emitting units in the eighth row and the light-emitting units in the ninth row.

In this embodiment, the first terminals of the first transistors Q10, Q11, and Q12 are respectively connected to the scan lines A1, A2 and A3, the first terminals of the second transistors Q13, Q14, and Q15 are respectively connected to the scan lines A4, A5, and A6, the second terminals of the first transistors Q10, Q11, and Q12 are all connected to the drive chip pin N1, the second terminals of the second transistors Q13, Q14, and Q15 are all connected to the drive chip pin N2, and thus, one drive chip pin is omitted.

Figure 4:
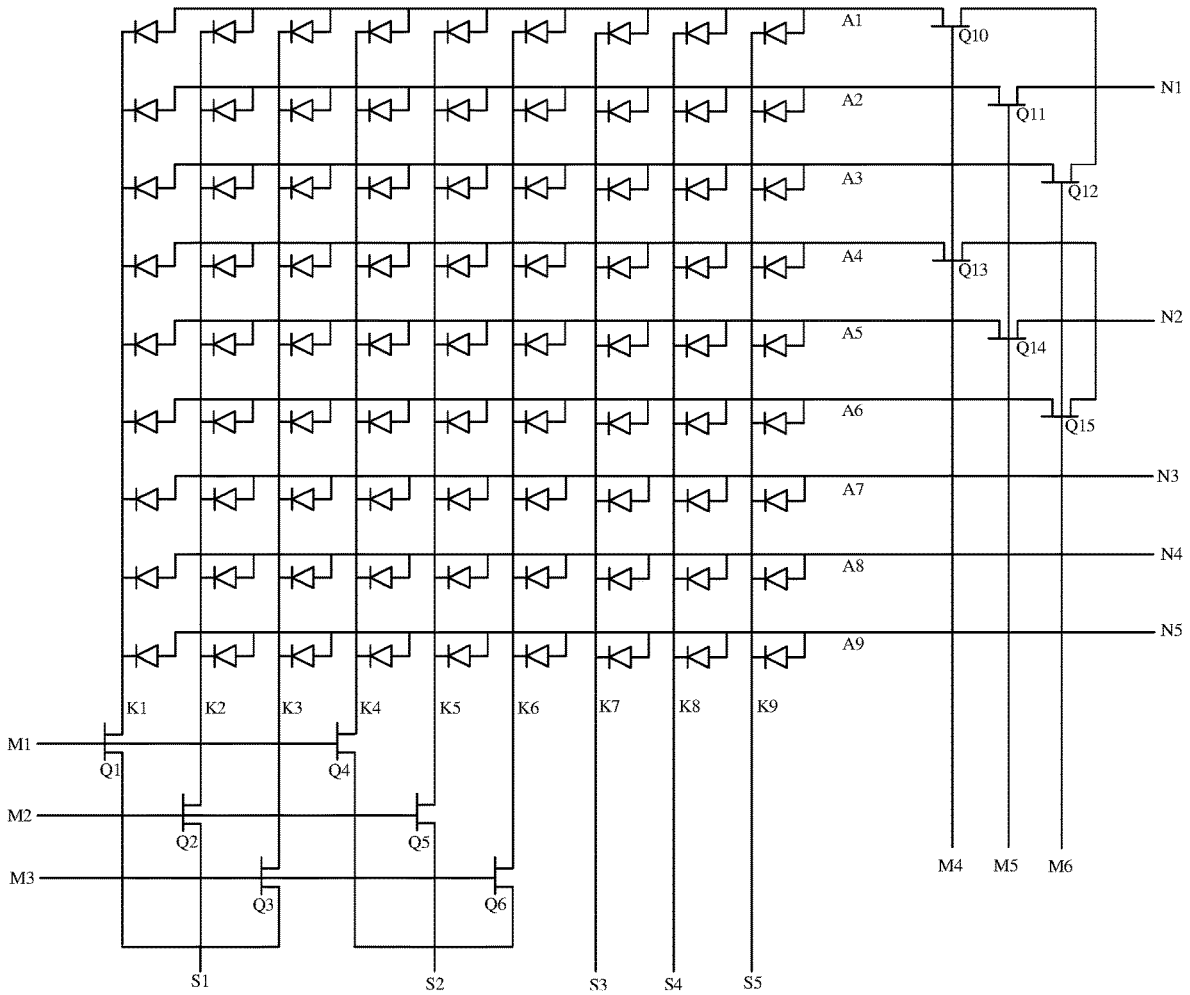
FIG. 4 is a principle diagram of a second embodiment of the backlight drive circuit of the present disclosure.

Please refer to FIG. 4 which is a principle diagram of the second embodiment of the backlight drive circuit of the present disclosure. This embodiment differs from the above embodiment in the following aspects: in this embodiment, part of the scan lines are connected to first terminals of first transistors, another part of the scan lines are connected to first terminals of second transistors, part of the data lines are connected to first terminals of third transistors, and another part of the data lines are connected to first terminals of fourth transistors. Particularly, the scan lines A1, A2, and A3 are respectively connected to first terminals of first transistors Q10, Q11, and Q12, the scan lines A4, A5 and A6 are respectively connected to first terminals of second transistors Q13, Q14, and Q15, and the scan lines A7, A8, and A9 are respectively and directly connected to the drive chip pins N3, N4, and N5; the data lines K1, K2, and K3 are respectively connected to first terminals of third transistors Q1, Q2, and Q3, the data lines K4, K5, and K6 are respectively connected to first terminals of fourth transistors Q4, Q5, and Q6, and the data lines K7, K8, and K9 are respectively and directly connected to the drive chip pins S3, S4, and S5. Control terminals of the first transistors Q10 and the second transistors Q13 are connected to the first control line M4, the control terminals of the first transistors Q11 and the second transistors Q14 are connected to the first control line M5, and the control terminals of the first transistors Q12 and the second transistors Q15 are connected to the control line M6; the control terminals of the third transistors Q1 and the fourth transistors Q4 are connected to the second control line M1, the control terminals of the third transistors Q2 and the fourth transistors Q5 are connected to the second control line M2, and the control terminals of the third transistors Q3 and the fourth transistors Q6 are connected to the second control line M3.

In this embodiment, 16 drive chip pins are used. Compared with the prior art, the backlight drive circuit in this embodiment can omit two drive chip pins.

Figure 5:
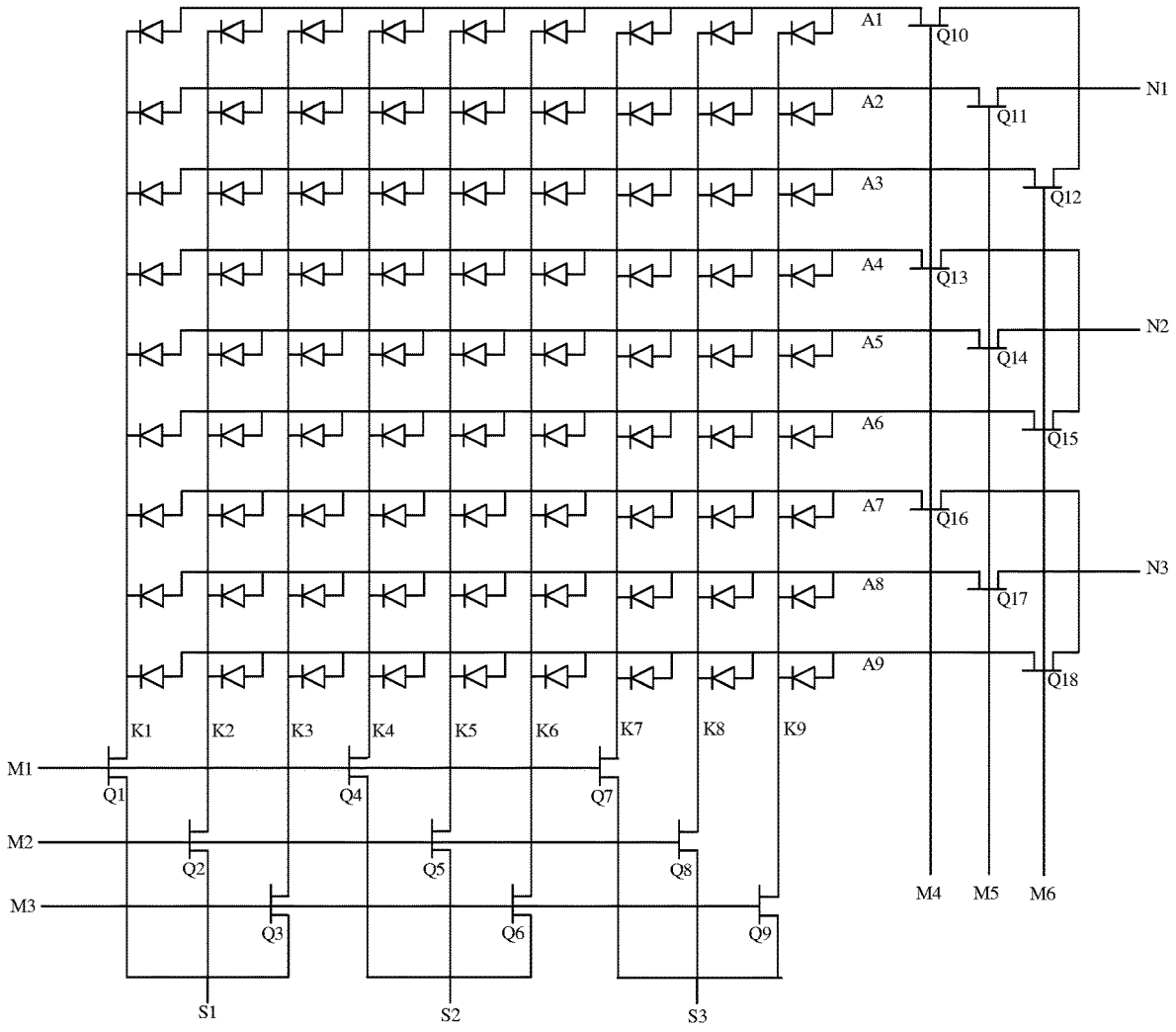
FIG. 5 is a principle diagram of a third embodiment of the backlight drive circuit of the present disclosure.

Please refer to FIG. 5 which is a principle diagram of a third embodiment of the backlight drive circuit of the present disclosure. Different from the two embodiments mentioned above, in this embodiment, each scan line is connected to a first terminal of a first transistor or a second transistor, and each data line is connected to a first terminal of a third transistor or a fourth transistor. Q10, Q11, and Q12 are first transistors, Q13, Q14, and Q15 are second transistors, and Q16, Q17, and Q18 are first transistors. When more rows of scan lines are included, the scan lines are configured in the same way. Every three adjacent rows of scan lines are sequentially and alternately connected to the first terminals of the first transistors and the first terminals of the second transistors, particularly, the scan lines A1-A3 are connected to the first terminals of the first transistors Q10, Q11, and Q12, the scan lines A4-A6 are connected to the first terminals of the second transistors Q13, Q14, and Q15, and the scan lines A7-A9 are connected to the first terminals of the first transistors Q16, Q17, and Q18. Second terminals of the three different first transistors connected to the every three adjacent rows of scan lines are connected to the same drive chip pin, particularly, the second terminals of the first transistors Q10, Q11, and Q12 are connected to the drive chip pin N1, and the second terminals of the first transistors Q16, Q17, and Q18 are connected to the drive chip pin N3. Control terminals of the three different first transistors connected to every three adjacent rows of scan lines are connected to three different adjacent first control lines, particularly, the control terminals of the first transistors Q10, Q11, and Q12 are respectively connected to the first control lines M4, M5, and M6, and the control terminals of the first transistors Q16, Q17, and Q18 are respectively connected to the first control lines M4, M5, and M6. Second terminals of the three different second transistors connected to every three adjacent rows of scan lines are connected to the same drive chip pin, particularly, the second terminals of the second transistors Q13, Q14, and Q15 are connected to the drive chip pin N2. Control terminals of the three different second transistors connected to every three adjacent rows of scan lines are connected to three different adjacent first control lines, particularly, the control terminals of the second transistors Q13, Q14, and Q15 are respectively connected to the first control lines M4, M5, and M6.

Meanwhile, every three adjacent columns of data lines are sequentially and alternately connected to first terminals of the third transistors and first terminals of the fourth transistors, particularly, the data lines K1, K2, and K3 are connected to the first terminals of the third transistors Q1, Q2, and Q3, the data lines K4, K5, and K6 are connected to the first terminals of the fourth transistors Q4, Q5, and Q6, and the data lines K7, K8, and K9 are connected to the first terminals of the third transistors Q7, Q8, and Q9. Second terminals of the three different third transistors connected to every three adjacent columns of data lines are connected to the same drive chip pin, particularly, the second terminals of the third transistors Q1, Q2, and Q3 are connected to the drive chip pin S1, and the second terminals of the third transistors Q7, Q8, and Q9 are connected to the drive chip pin S2. Control terminals of the three different third transistors connected to every three adjacent columns of data lines are connected to three different adjacent second control lines, particularly, the control terminals of the third transistors Q1, Q2, and Q3 are respectively connected to the second control lines M1, M2, and M3, and the control terminals of the third transistors Q7, Q8, and Q9 are respectively connected to the second control lines M1, M2, and M3. Second terminals of the three different fourth transistors connected to every three adjacent columns of data lines are connected to the same drive chip pin, particularly, the second terminals of the fourth transistors Q4, Q5, and Q6 are connected to the drive chip pin S2. Control terminals of the three different fourth transistors connected to every three adjacent columns of data lines are connected to three different adjacent second control lines, particularly, the control terminals of the fourth transistors Q4, Q5, and Q6 are respectively connected to the second control lines M1, M2, and M3.

The operating process of the backlight drive circuit in FIG. 5 is as follows: a first control signal is input from the first control line M4, a scanning signal is input via the drive chip pin N1 and is transmitted to the light-emitting units in the first row, a second control signal is input via the second control line M1 at the same time, and a data signal is input to the data lines K1-K9 respectively via the drive chip pins S1-S3, so that the first light-emitting unit, the fourth light-emitting unit, and the seventh light-emitting unit in the first row are turned on; M1 is turned off, the second control signal is input via the second control line M2, and the data signal is input to the data lines K1-K9 respectively via the drive chip pins S1-S3, so that the second light-emitting unit, the fifth light-emitting unit, and the eighth light-emitting unit in the first row are turned on; M2 is turned off, the second control signal is input via the second control line M3, the data signal is input to the data lines K1-K9 respectively via the drive chip pins S1-S3, so that the third light-emitting unit, the sixth light-emitting unit, and the ninth light-emitting unit in the first row are turned on. In this way, all the light-emitting units in the first row are turned on. The above steps are repeated to sequentially turn on the light-emitting units in the second, third, fourth, fifth, sixth, seventh, eighth, and ninth rows.

In this embodiment, 12 drive chip pins are used. Compared with the prior art, the backlight drive circuit in this embodiment can omit six drive chip pins.

In this embodiment, every three adjacent rows of scan lines are sequentially and alternately connected to the first terminals of the first transistors and the first terminals of the second transistors, the second terminals of every three adjacent rows of first transistors or second transistors are connected to the same drive chip pin, every three adjacent columns of data lines are sequentially and alternately connected to the first terminals of the third transistors and the first terminals of the fourth transistors, the second terminals of every three adjacent columns of third transistors or fourth transistors are connected to the same drive chip pin, and thus, the number of the drive chip pins is reduced.

Figure 6:
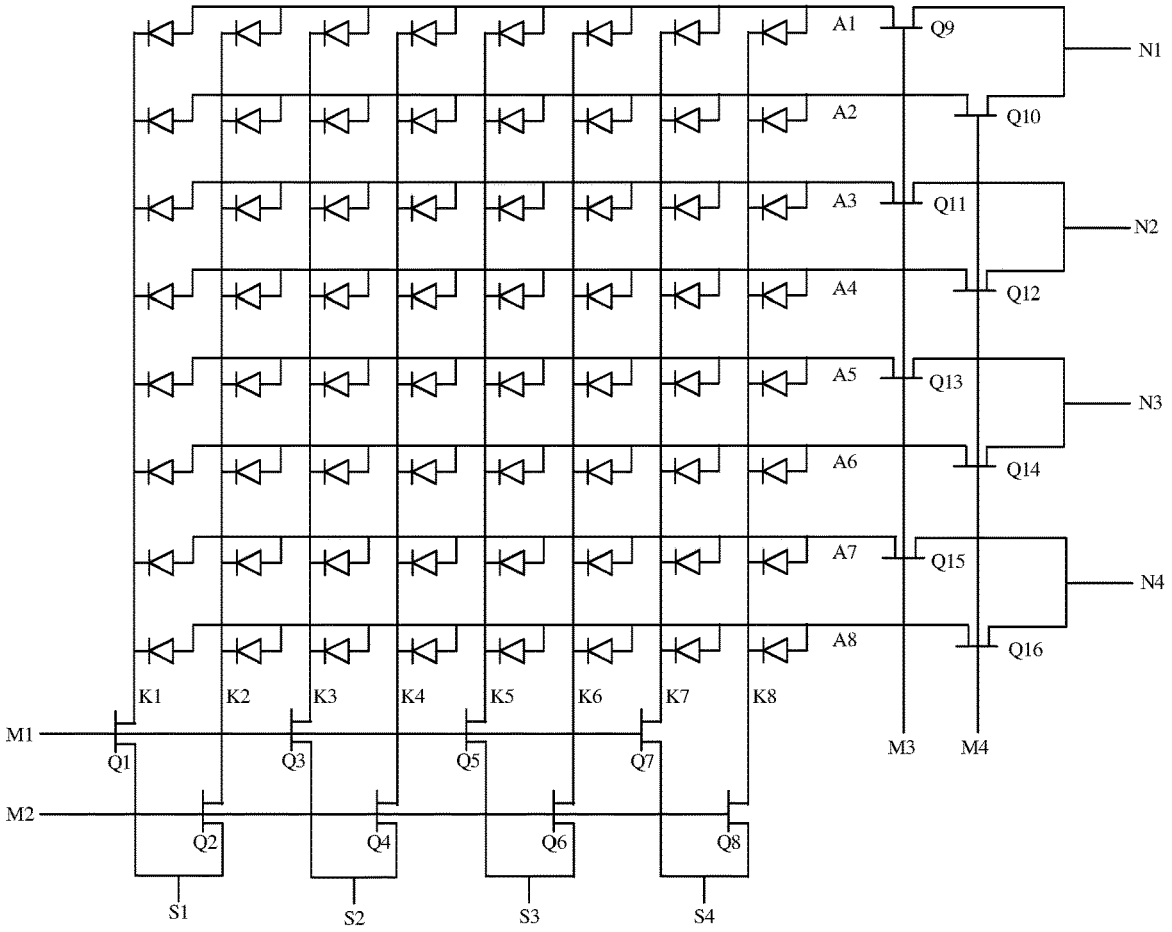
FIG. 6 is a principle diagram of a fourth embodiment of the backlight drive circuit of the present disclosure.

Please refer to FIG. 6 which is a principle diagram of a fourth embodiment of the backlight drive circuit of the present disclosure. As shown in FIG. 6, in the backlight drive circuit, the number of first transistors is four, and the number of second transistors is also four; every two adjacent rows of scan lines are sequentially and alternately connected to first terminals of the first transistors and the second transistors, particularly, the scan lines A1 and A2 are connected to the first terminals of the first transistors Q9 and Q10, the scan lines A3 and A4 are connected to the first terminals of the second transistors Q11 and Q12, the scan lines A5 and A6 are connected to the first terminals of the first transistors Q13 and Q14, and the scan lines A7 and A8 are connected to the first terminals of the second transistors Q15 and Q16. When more rows of scan lines are included, the scan lines are configured in the same way. Second terminals of every two different adjacent first transistors are connected to the same drive chip pin, particularly, the second terminals of the first transistors Q9 and Q10 are connected to the drive chip pin N1, and the second terminals of the first transistors Q13 and Q14 are connected to the drive chip pin N3. Control terminals of every two different adjacent first transistors are connected to different adjacent first control lines, particularly, the control terminals of the first transistors Q9 and Q10 are respectively connected to the first control lines M3 and M4, and the control terminals of the first transistors Q13 and Q14 are respectively connected to the first control lines M3 and M4. Second terminals of every two different adjacent second transistors are connected to the same drive chip pin, particularly, the second terminals of the second transistors Q11 and Q12 are connected to the drive chip pin N2, and the second terminals of the second transistors Q15 and Q16 are connected to the drive chip pin N4. Control terminals of every two different adjacent second transistors are connected to different adjacent first control lines, particularly, the control terminals of the second transistors Q11 and Q12 are respectively connected to the first control lines M3 and M4, and the control terminals of the second transistors Q15 and Q16 are respectively connected to the first control lines M3 and M4.

Every two adjacent columns of data lines are sequentially and alternately connected to first terminals of third transistors and first terminals of fourth transistors, particularly, the data lines K1 and K2 are connected to the first terminals of the third transistors Q1 and Q2, the data lines K3 and K4 are connected to the first terminals of the fourth transistors Q3 and Q4, the data lines K5 and K6 are connected to the first terminals of the third transistors Q5 and Q6, and the data lines K7 and K8 are connected to the first terminals of the fourth transistors Q7 and Q8. When more columns of data lines are included, the data lines are configured in the same way. Second terminals of every two different adjacent third transistors are connected to the same drive chip pin, particularly, the second terminals of the third transistors Q1 and Q2 are connected to the drive chip pin S1, and the second terminals of the third transistors Q5 and Q6 are connected to the drive chip pin S3. Control terminals of every two different adjacent third transistors are connected to different adjacent second control lines, particularly, the control terminals of the third transistors Q1 and Q2 are respectively connected to the second control lines M3 and M4, and the control terminals of the third transistors Q13 and Q14 are respectively connected to the second control lines M1 and M2. Second terminals of every two different adjacent fourth transistors are connected to the same drive chip pin, particularly, the second terminals of the fourth transistors Q3 and Q4 are connected to the drive chip pin S2, and the second terminals of the fourth transistors Q7 and Q8 are connected to the drive chip pin S4. Control terminals of every two different adjacent fourth transistors are connected to different adjacent second control lines, particularly, the control terminals of the fourth transistors Q3 and Q4 are respectively connected to the second control lines M1 and M2, and the control terminals of the fourth transistors Q7 and Q8 are respectively connected to the second control lines M1 and M2.

The operating process of the backlight drive circuit in FIG. 6 is as follows: a first control signal is input from the first control line M4, a scanning signal is input via the drive chip pin N1 and is transmitted to the light-emitting units in the first row, a second control signal is input via the second control line M1 at the same time, and a data signal is input to the data lines K1-K8 respectively via the drive chip pins S1-S4, so that the first light-emitting unit, the third light-emitting unit, the fifth light-emitting unit, and the seventh light-emitting unit in the first row are turned on; M1 is turned off, the second control signal is input via the second control line M2, and the data signal is input to the data lines K1-K8 respectively via the drive chip pins S1-S4, so that the second light-emitting unit, the fourth light-emitting unit, the sixth light-emitting unit, and the eighth light-emitting unit in the first row are turned on. In this way, all the light-emitting units in the first row are turned on. The above steps are repeated to sequentially turn on the light-emitting units in the second, third, fourth, fifth, sixth, seventh, and eighth rows.

In this embodiment, 12 drive chip pins are used. Compared with the prior art, the backlight drive circuit in this embodiment can omit four drive chip pins.

In this embodiment, every two adjacent rows of scan lines are sequentially and alternately connected to the first terminals of the first transistors and the first terminals of the second transistors, the second terminals of every two adjacent rows of first transistors or second transistors are connected to the same drive chip pin, every two adjacent columns of data lines are sequentially and alternately connected to the first terminals of the third transistors and the first terminals of the fourth transistors, the second terminals of every two adjacent columns of third transistors or fourth transistors are connected to the same drive chip pin, and thus, the number of the drive chip pins is reduced.

In FIG. 5, every three adjacent rows of scan lines are sequentially and alternately connected to the first terminals of the first transistors and the first terminals of the second transistors, and every three adjacent columns of data lines are sequentially and alternately connected to the first terminals of the third transistors and the first terminals of the fourth transistors. In FIG. 6, every two adjacent rows of scan lines are sequentially and alternately connected to the first terminals of the first transistors and the first terminals of the second transistors, and every two adjacent columns of data lines are sequentially and alternately connected to the first terminals of the third transistors and the first terminals of the fourth transistors. In other embodiments, the configuration that every four, five, or more adjacent rows of scan lines are sequentially and alternately connected to the first terminals of the first transistors and the first terminals of the second transistors, and every four, five, or more adjacent columns of data lines are sequentially and alternately connected to the first terminals of the third transistors and the first terminals of the fourth transistors can also be adopted, and the present disclosure has no specific limitation in this regard.

Figure 7:
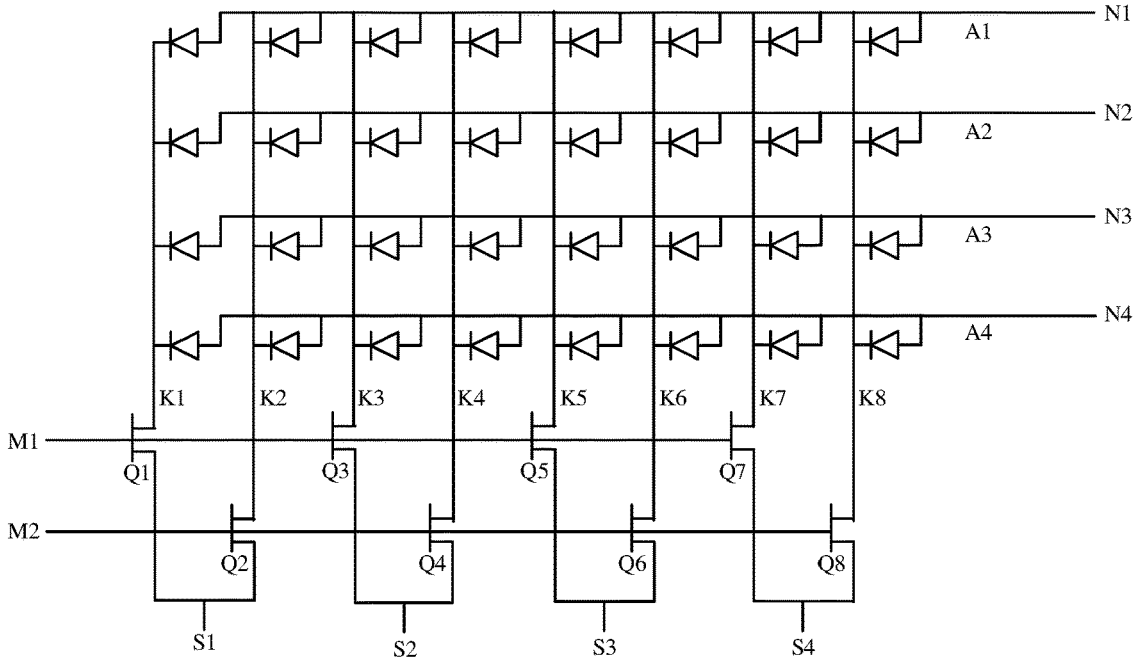
FIG. 7 is a principle diagram of a fifth embodiment of the backlight drive circuit of the present disclosure.
Figure 8:
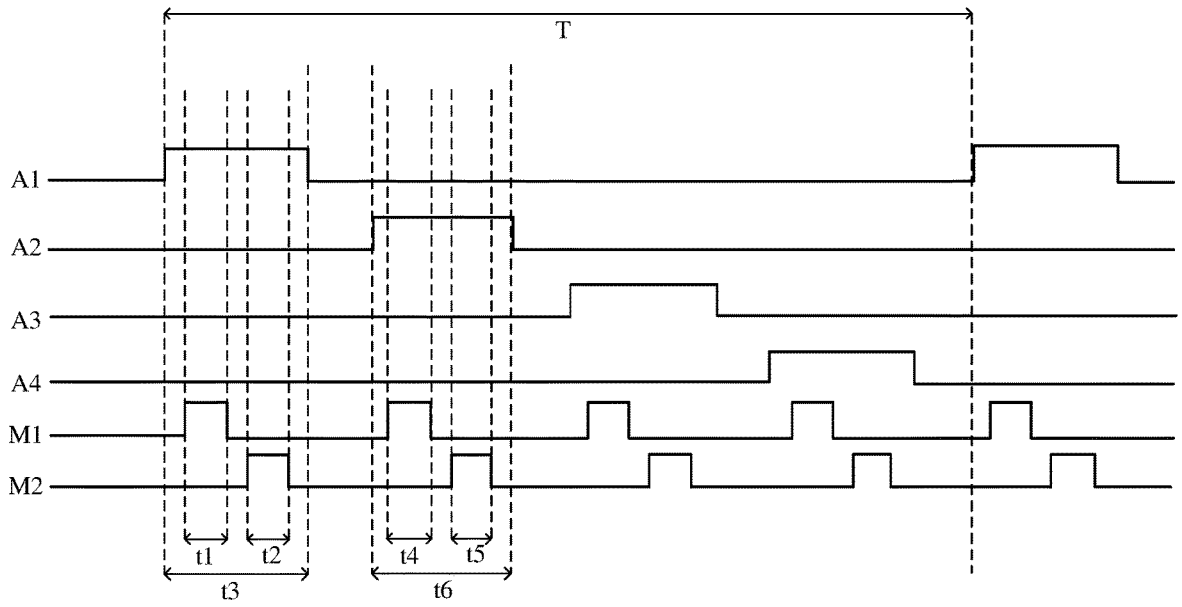
FIG. 8 is an operating time sequence diagram of the backlight drive circuit of FIG. 7.

Please refer to FIG. 7 and FIG. 8, wherein FIG. 7 is a principle diagram of a fifth embodiment of the backlight drive circuit of the present disclosure, and FIG. 8 is an operating time sequence diagram of the backlight drive circuit in FIG. 7. In FIG. 7, the scan lines A1-A4 are respectively and directly connected to the drive chip pins N1-N4, and the data lines K1-K8 are respectively and directly connected to the first terminals of the transistors Q1-Q8. In FIG. 8, the scan line A1 is at a high level in a time period t3, which corresponds to the process of inputting a high-level scanning signal to the scan line A1 via the drive chip pin N1 in FIG. 7. A first high-level control signal is input to the first control line M1 (namely the first control signal of the first control line M1 in FIG. 8 is at a high level in a time period t1), and a data signal is input via the drive chip pins S1-S4, so that the first light-emitting unit, the third light-emitting unit, the fifth light-emitting unit, and the seventh light-emitting unit in the first row are turned on; M1 is turned off, the first control signal of M1 is at a low level, the first high-level control signal is input to the first control line M2 (namely the first control signal of the first control line M2 is at a high level in a time period t2), and the data signal is input via the drive chip pins S1-S4, so that the second light-emitting unit, the fourth light-emitting unit, the sixth light-emitting unit, and the eighth light-emitting unit in the first row are turned on. In this way, the eight light-emitting units in the first row are all turned on. Afterwards, A1 is turned off, the high-level scanning signal is input to the second scan line A2 via the drive chip pin N2 (namely the scan line A2 in FIG. 8 is at a high level in a time period t6). The first high-level control signal is input to the first control line M1 (namely the first control signal of the first control line M1 in FIG. 8 is at a high level in a time period t4), and the data signal is input via the drive chip pins S1-S4, so that the first light-emitting unit, the third light-emitting unit, the fifth light-emitting unit, and the seventh light-emitting unit in the first row are turned on; M1 is turned off, the first control signal of M1 is at a low level, the first high-level control signal is input to the first control line M2 (namely the first control signal of the first control line M2 is at a high level in a time period t5), and the data signal is input via the drive chip pins S1-S4, so that the second light-emitting unit, the fourth light-emitting unit, the sixth light-emitting unit, and the eighth light-emitting unit in the first row are turned on. In this way, the eight light-emitting units in the second row are all turned on.

The light-emitting units in the third row and the fourth row are sequentially turned on in the same way. The light-emitting units in the four rows in FIG. 7 are all turned on in a time T, namely a cycle, and the above steps can be repeated in the next cycle.

The present disclosure has the following beneficial effects: different from the prior art, the backlight drive circuit of the present disclosure comprises a plurality of light-emitting units arrayed in a matrix manner and at least first transistors and second transistors, control terminals of each first transistor and the corresponding second transistor are connected to the same control line, at least part of scan lines and/or data lines are connected to first terminals of the first transistors, and at least part of the scan lines and/or data lines are connected to first terminals of the second transistors, so that the number of drive chip pins connected to second terminals of the first transistors and the second transistors is reduced, and accordingly, the reliability of products is improved.

Figure 9:
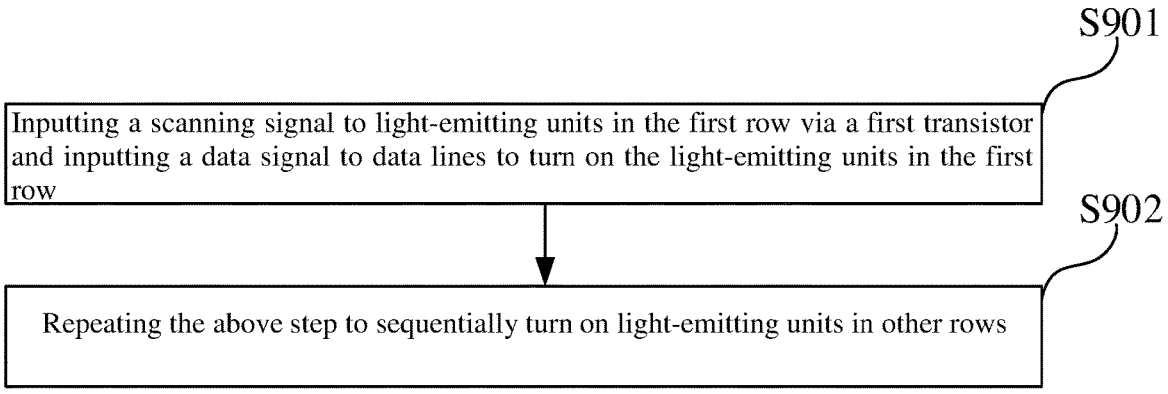
FIG. 9 is a flow diagram of a driving method of a backlight drive circuit of the present disclosure.

Please refer to FIG. 9 which is a flow diagram of a driving method of a backlight drive circuit of the present disclosure. The driving method comprises the following steps:

Step 901, a scanning signal is input to light-emitting units in the first row via a first transistor and a second transistor, and a data signal is input to data lines, so that the light-emitting units in the first row are turned on.

In one embodiment, referring to FIG. 6 again, a scanning signals is input via the second terminals of the first transistors Q9 and Q10 connected to the first and second rows scan lines A1 and A2, and a first control signal is input to the first control line M3 connected to the control terminal of the first transistor Q9 in the first row to transmit the scanning signal to the light-emitting units in the first row; a data signal is input to the second terminals of the third transistors and the fourth transistors via the drive chip pins S1-S4, and a second control signal is input to the second control line M1, so that part of the light-emitting units in the first row are turned on, namely, the first light-emitting unit, the third light-emitting unit, the fifth light-emitting unit, and the seventh light-emitting unit in the first row are turned on; the second control line M1 is turned off, and the second control signal is input to the second control line M2, so that the other part of the light-emitting units in the first row are turned on, namely the second light-emitting unit, the fourth light-emitting unit, the sixth light-emitting unit, and the eighth light-emitting unit in the first row are turned on. In this way, all the light-emitting units in the first row are turned on.

The step in other embodiments is similar to the above step and will no longer be described herein.

Step 902, the above step is repeated to sequentially turn on the light-emitting units in other rows.

The present disclosure further provides a display device. The display device comprises the backlight drive circuit in any one of the embodiments mentioned above.

Figure 10:
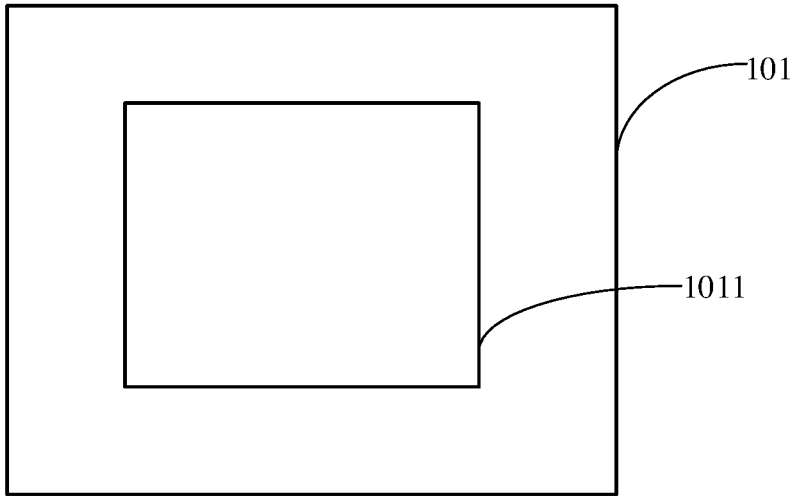
FIG. 10 is a structural view of a display device of the present disclosure.

Please refer to FIG. 10 which is a structural view of the display device of the present disclosure. As shown in FIG. 10, the display device 101 comprises a backlight drive circuit 1011. The backlight drive circuit 1011 can be the backlight drive circuit in any one of the embodiments mentioned above.

The present disclosure has the following beneficial effects: different from the prior art, the backlight drive circuit of the present disclosure comprises a plurality of light-emitting units arrayed in a matrix manner and at least first transistors and second transistors, control terminals of each first transistor and the corresponding second transistor are connected to the same control line, at least part of scan lines and/or data lines are connected to first terminals of the first transistors, and at least part of the scan lines and/or data lines are connected to first terminals of the second transistors, so that the number of drive chip pins connected to second terminals of the first transistors and the second transistors is reduced, and accordingly, the reliability of products is improved.

The above are merely embodiments of the present disclosure and are not intended to limit the patent scope of the present disclosure. Any modifications of equivalent structure or equivalent process made on the basis of the contents of the description and accompanying drawings of the present disclosure or directly or indirectly applied to other related technical fields shall similarly fall within the scope of patent protection of the present disclosure.

What is claimed is:

1. A backlight drive circuit comprising: a plurality of light-emitting units arrayed in a matrix manner and at least first transistors and second transistors, wherein the light-emitting units in each row are connected to a scan line, the light-emitting units in each column are connected to a data line, at least part of the scan lines and/or the data lines are connected to first terminals of the first transistors, at least part of the scan lines and/or the data lines are connected to first terminals of the second transistors, second terminals of the first transistors and the second transistors are respectively connected to drive chip pins, control terminals of the first transistors and the second transistors are connected to a first control line;

wherein the number of the first transistors is at least two, and the number of the second transistors is at least two; the second terminals of every two different adjacent first transistors are connected to the same drive chip pin, the control terminals of every two different adjacent first transistors are connected to the different adjacent first control lines, the second terminals of every two different adjacent second transistors are connected to the same drive chip pin, and the control terminals of every two different adjacent second transistors are connected to the different adjacent first control lines.

2. The backlight drive circuit according to claim 1, wherein the backlight drive circuit further comprises at least third transistors and fourth transistors, each scan line is connected to the first terminal of the first transistor or the second transistor, at least part of the data lines are connected to first terminals of the third transistors, at least part of the data lines are connected to first terminals of the fourth transistors, second terminals of the third transistors and the fourth transistors are connected to drive chip pins, and control terminals of the third transistor and the fourth transistor are connected to a second control line.

3. The backlight drive circuit according to claim 2, wherein every two adjacent rows of scan lines are sequentially and alternately connected to the first terminals of the first transistors and the first terminals of the second transistors, the second terminals of the two different first transistors connected to every two adjacent rows of scan lines are connected to the same drive chip pin, the control terminals of the two different first transistors connected to every two adjacent rows of scan lines are connected to the two different adjacent first control lines, the second terminals of the two different second transistors connected to every two adjacent rows of scan lines are connected to the same drive chip pin, and the control terminals of the two different second transistors connected to every two adjacent rows of scan lines are connected to the two different adjacent first control lines.

4. The backlight drive circuit according to claim 2, wherein the number of the third transistors is at least two, and the number of the fourth transistors is at least two; the second terminals of every two different adjacent third transistors are connected to the same drive chip pin, the control terminals of the every two different adjacent third transistors are connected to the different adjacent second control lines, the second terminals of every two different adjacent fourth transistors are connected to the same drive chip pin, and the control terminals of every two different adjacent fourth transistors are connected to the different adjacent second control lines.

5. The backlight drive circuit according to claim 4, wherein every two adjacent columns of data lines are sequentially and alternately connected to the first terminals of the third transistors and the first terminals of the fourth transistors, the second terminals of the two different third transistors connected to every two adjacent columns of data lines are connected to the same drive chip pin, the control terminals of the two different third transistors connected to every two adjacent columns of data lines are connected to the two different adjacent second control line, the second terminals of the two different fourth transistors connected to every two adjacent columns of data lines are connected to the same drive chip pin, and the control terminals of the two different fourth transistors connected to every two adjacent columns of data lines are connected to the two different adjacent second control lines.

6. A display device comprising:

a backlight drive circuit comprising a plurality of light-emitting units arrayed in a matrix manner and at least first transistors and second transistors, wherein the light-emitting units in each row are connected to a scan line, the light-emitting units in each column are connected to a data line, at least part of the scan lines and/or the data lines are connected to first terminals of the first transistors, at least part of the scan lines and/or the data lines are connected to first terminals of the second transistors, second terminals of the first transistors and the second transistors are respectively connected to drive chip pins, control terminals of the first transistors and the second transistors are connected to a first control line;

wherein the number of the first transistors is at least two, and the number of the second transistors is at least two; the second terminals of every two different adjacent first transistors are connected to the same drive chip pin, the control terminals of every two different adjacent first transistors are connected to the different adjacent first control lines, the second terminals of every two different adjacent second transistors are connected to the same drive chip pin, and the control terminals of every two different adjacent second transistors are connected to the different adjacent first control lines.

7. The display device according to claim 6, wherein the backlight drive circuit further comprises at least third transistors and fourth transistors, each scan line is connected to the first terminal of the first transistor or the second transistor, at least part of the data lines are connected to first terminals of the third transistors, at least part of the data lines are connected to first terminals of the fourth transistors, second terminals of the third transistors and the fourth transistors are connected to drive chip pins, and control terminals of the third transistor and the fourth transistor are connected to a second control line.

8. The display device according to claim 7, wherein every two adjacent rows of scan lines are sequentially and alternately connected to the first terminals of the first transistors and the first terminals of the second transistors, the second terminals of the two different first transistors connected to every two adjacent rows of scan lines are connected to the same drive chip pin, the control terminals of the two different first transistors connected to every two adjacent rows of scan lines are connected to the two different adjacent first control lines, the second terminals of the two different second transistors connected to every two adjacent rows of scan lines are connected to the same drive chip pin, and the control terminals of the two different second transistors connected to every two adjacent rows of scan lines are connected to the two different adjacent first control lines.

9. The display device according to claim 8, wherein the number of the third transistors is at least two, and the number of the fourth transistors is at least two; the second terminals of every two different adjacent third transistors are connected to the same drive chip pin, the control terminals of the every two different adjacent third transistors are connected to the different adjacent second control lines, the second terminals of every two different adjacent fourth transistors are connected to the same drive chip pin, and the control terminals of every two different adjacent fourth transistors are connected to the different adjacent second control lines.

10. The display device according to claim 9, wherein every two adjacent columns of data lines are sequentially and alternately connected to the first terminals of the third transistors and the first terminals of the fourth transistors, the second terminals of the two different third transistors connected to every two adjacent columns of data lines are connected to the same drive chip pin, the control terminals of the two different third transistors connected to every two adjacent columns of data lines are connected to the two different adjacent second control line, the second terminals of the two different fourth transistors connected to every two adjacent columns of data lines are connected to the same drive chip pin, and the control terminals of the two different fourth transistors connected to every two adjacent columns of data lines are connected to the two different adjacent second control lines.

11. A driving method of a backlight drive circuit, wherein the backlight drive circuit comprises a plurality of light-emitting units arrayed in a matrix manner and at least first transistors and second transistors, the light-emitting units in each row are connected to a scan line, the light-emitting units in each column are connected to a data line, at least part of the scan lines and/or the data lines are connected to first terminals of the first transistors, at least part of the scan lines and/or the data lines are connected to first terminals of the second transistors, second terminals of the first transistors and the second transistors are respectively connected to drive chip pins, and control terminals of the first transistors and the second transistors are connected to a first control line; the driving method comprises:

inputting a scanning signal to the light-emitting units in a first row via the first transistor and inputting a data signal to the data lines so as to turn on the light-emitting units in the first row;

repeating the step to sequentially turn on the light emitting units in other rows;

wherein every two adjacent rows of data lines are sequentially and alternately connected to the first terminals of the first transistors and the first terminals of the second transistors, the second terminals of the two different first transistors connected to every two adjacent rows of scan lines are connected to the same drive chip pin, the control terminals of the two different first transistors connected to every two adjacent rows of scan lines are connected to the two different adjacent first control lines; the second terminals of the two different second transistors connected to every two adjacent rows of scan lines are connected to the same drive chip pin, the control terminals of the two different second transistors connected to every two adjacent rows of scan lines are connected to the two different adjacent first control lines; inputting the scanning signal to the light-emitting units in the first row via the first transistor and the second transistor and inputting the data signal to the data lines so as to turn on the light-emitting units in the first row comprises:

inputting the scanning signal via the second terminal of the first transistor connected to the scan lines in first and second rows and inputting a first control signal to the first control line connected to the control terminal of the first transistor in the first row so as to transmit the scanning signal to the light-emitting units in the first row; and inputting the data signal to the data lines so as to turn on the light-emitting units in the first row.

12. The driving method according to claim 11, wherein every two adjacent columns of data lines are sequentially and alternately connected to first terminals of third transistors and first terminals of fourth transistors, second terminals of the two different third transistors connected to every two adjacent columns of data lines are connected to a same drive chip pin, control terminals of the two different third transistors connected to every two adjacent columns of data lines are connected to two different adjacent second control lines, second terminals of the two different fourth transistors connected to every two adjacent columns of data lines are connected to a same drive chip pin, and control terminals of the two different fourth transistors connected to every two adjacent columns of data lines are connected to different adjacent second control lines; and inputting the data signal to the data lines to turn on the light-emitting units in the first row comprises:

inputting the scanning signal via the second terminal of the first transistors connected to the scan lines in the first and second rows and inputting the first control signal to the first control line connected to the control terminal of the first transistor in the first row so as to transmit the scanning signal to the light-emitting units in the first row;

inputting the data signal to the second terminals of the third transistors and the fourth transistors and inputting a second control signal to one of the second control lines so as to turn on part of the light-emitting units in the first row; and turning off one of the second control line and inputting the second control signal to another one of the second control lines so as to turn on another part of the light-emitting units in the first row.

* * * * *